US005960887A

United States Patent [19]

Crabtree

[11] Patent Number: 5,960,887

[45] Date of Patent: Oct. 5, 1999

[54] BY-PASS EDUCTOR

[75] Inventor: Dennis Crabtree, Beaumont, Tex.

[73] Assignee: Williams Fire & Hazard Control, Inc., Vidor, Tex.

[21] Appl. No.: 08/991,197

[22] Filed: Dec. 16, 1997

Related U.S. Application Data

[60] Provisional application No. 60/032,669, Dec. 16, 1996.

[51] Int. Cl.[6] ..... A62C 31/12

[52] U.S. Cl. ..... 169/15; 169/14; 239/318; 239/416.5

[58] Field of Search ..... 169/14, 15; 239/317, 239/318, 427, 428, 443, 444, 416.5, 417.3

[56] References Cited

U.S. PATENT DOCUMENTS 2,953,160 9/1960 Brazier ..... 169/14

3,282,227 11/1966 Nielsen ..... 239/318

5,113,945 5/1992 Cable ..... 169/15

*Primary Examiner*—Andres Kashnikow

*Assistant Examiner*—David Deal

*Attorney, Agent, or Firm*—Sue Z. Shaper; Butler & Binion, L.L.P.

[57] ABSTRACT

An improved additive eductor for supplying additives, including foam concentrates and thixotropic foam concentrates, into a hand line or waterline for supplying a nozzle used for fire fighting operations wherein the additive eductor can be operated in either eductive or non-eductive by-pass mode and further comprising in a prefered embodiment a back-flow preventative metering valve attached to a additive port.

9 Claims, 4 Drawing Sheets

FIG. 2A
(PRIOR ART)
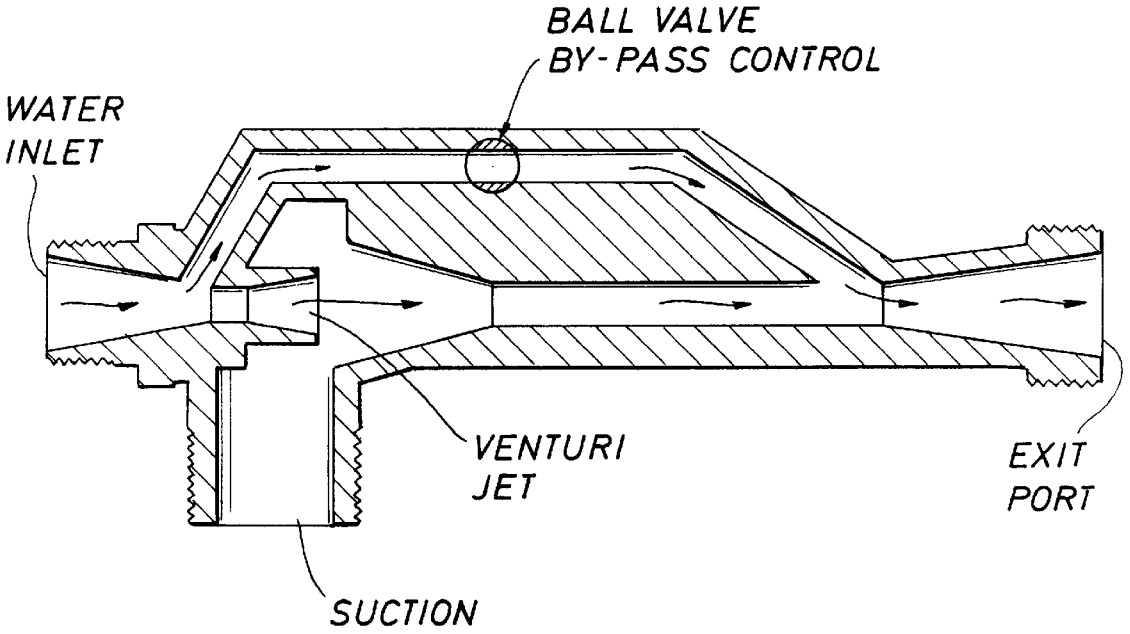
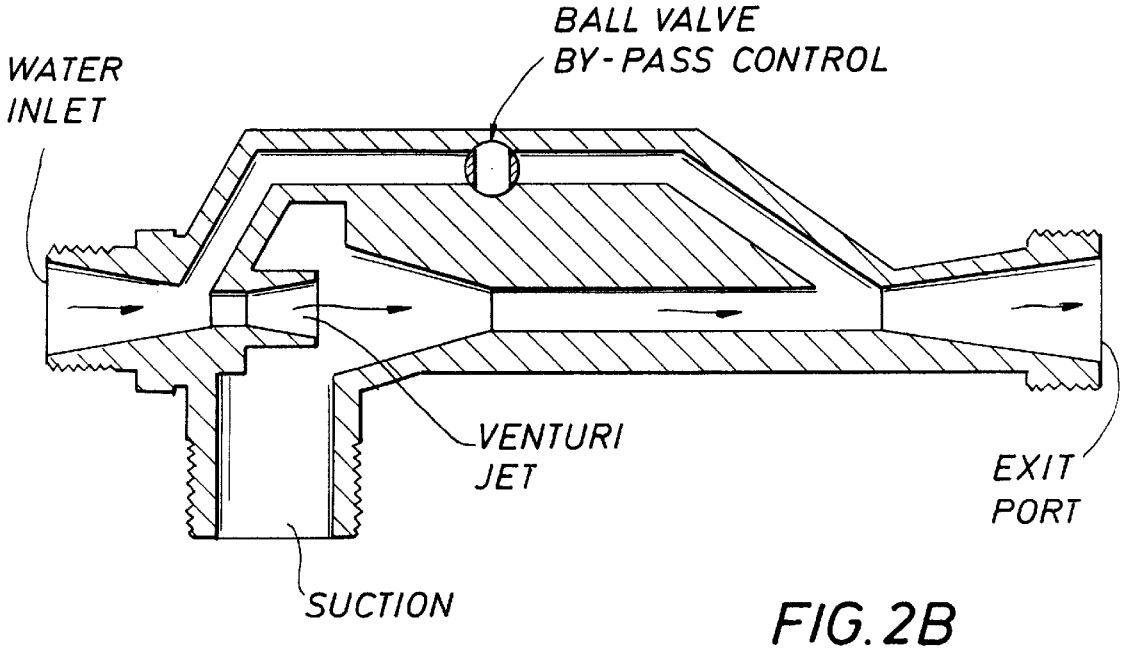
FIG. 2B
(PRIOR ART)

BY-PASS EDUCTOR

This invention is entitled to the benefit of an earlier filing date based on U.S. Provisional Application 60/032,669 filed Dec. 16, 1996.

BACKGROUND OF THE INVENTION

1. Field of the Invention

This invention relates to fluid additive supply systems for fire fighting mechanisms, and in particular to systems for adding foam concentrate into a waterline (handline that supplies a nozzle used for fire fighting operations).

2. Description of Related Art

Fire fighting mechanisms typically comprise of a source of water, the primary fire fighting fluid, connected to a water pump that supplies water under suitable pressure through a conduit (fire hose) to a monitor or hand held nozzle. It is often desirable also to have a portable mechanism that can supply an additive, such as foam concentrate, into the water line. The additive mechanisms may have a metering device that allows the proportioning to be varied from 0 to 6%.

The additive mechanisms may employ the basic design and principle of a venturi device and are typically called eductors or jet pumps by those familiar with this art. Such mechanisms use primary liquid flow to create a pressure drop across an orifice. The additive is drawn into a suction port inlet that is connected to the device in the low pressure zone that is created by this pressure drop.

There are numerous systems on the market for supplying additives to water lines. The majority of these systems are not portable. Many require additive pumps, such as foam concentrate additive pumps, for forced injection or induction. Additive pump systems are more complicated and expensive than eductive systems. By contrast venturi type eductors are economical and reliable. Such eductors are the focus of this invention.

The basic venturi eductors generally fall into one of two categories: by-pass, and non-by-pass eductors. By-pass eductors offer more versatility by allowing the drive water to "by-pass" the orifice or pressure drop area. In this mode, no additive is supplied to the water line. Additionally, since water is not forced through the pressure reducing orifice, more pressure and flow is available to the nozzle for water operations. (See FIG 1B) Pressure drop may be considered negligible in this mode. However, traditionally, by-pass systems are large and heavy and do not easily lend themselves to portable applications. (FIGS. 2A and B).

Non-by-pass eductors are considered to be the most basic of additive devices. They are inexpensive, lightweight and portable (FIG. 3) However, they operate in the "pressure drop" mode. This means that an unrecoverable pressure drop occurs across the orifice device, regardless of whether an additive is being drawn in or not. This permanent pressure loss is typically between 40% to 50% of the working inlet pressure. Such pressure drop comprises a waste of energy if additive is not desired, as is the case in water only applications.

SUMMARY OF THE INVENTION

The current invention is directed to an improved eductor assembly for supplying additives to a fluid supply line which is connected to a fire fighting nozzle or monitor. As used herein "nozzle" refers to the apparatus from which fire fighting compounds are directed or "thrown" at a fire. As used herein, "eductor assembly" refers to a device which utilizes a venturi jet to pull additives into a fluid supply line. The eductive assembly of the current invention combines the favorable attributes of a non-by-pass system with the versatility of the by-pass system. The design features a plurality of optional flow paths around the orifice device. This allows the device to function as a by-pass additive eductor. Since a large portion of the water is allowed to circumvent the orifice, a negligible pressure drop is created, ie. less than around 10% of inlet pressure or less than around 10 p.s.i. at 100 p.s.i. inlet pressure. No low pressure zone is created and additive is not introduced into the system. Upon rotation of an outer housing, the "by-pass" holes or paths are blocked. Now all water is forced through the orifice device producing sufficient pressure drop to educt an additive.

The present invention is unique in that the "by-pass" water is routed both through and around the orifice simultaneously in a portable monitor or nozzle. The invention also provides a more compact device than the traditional devices that route the water via a diversion valve through a separate flow conduit (FIGS. 2A & 2B).

The invention also incorporates a further advantage of being designed to proportion "thixotropic" foam concentrates as well as class "A" and class "B" AFFF (aqueous film forming foams). Thixotropic foams have a high viscosity, i.e., they gel when left gel when left stationary. As thixotropic concentrate is agitated or sheared, its viscosity is lowered, i.e., it becomes more liquid. This shear/agitation rate is dependent upon factors such as velocity in the pipe or conduit leading to the metering valve and the metering valve design. A difficulty that may be encountered with thixotropic foam concentrates is that their viscosity can cause the metering device to proportion lean (not enough additive is passing through). The present invention is designed to efficiently educt even thixotropic foam concentrates up to 6% solutions. Other useful features of this invention include:

1. A positive shut-off on the additive metering valve.

2. A positive checking feature to prevent water from back-flowing from the eductor and contaminating the foam concentrate source.

3. Operating pressures up to 250 PSI

4. Lightweight/compact design

BRIEF DESCRIPTION OF THE DRAWINGS

A better understanding of this invention can be obtained by combining the following description with the attached drawings.

FIGS. 2A and 2B illustrate a by-pass mode and an eduction mode respectively of nozzles of the prior art.

DETAILED DESCRIPTION OF PREFERRED ENVIRONMENT

Figure 4:
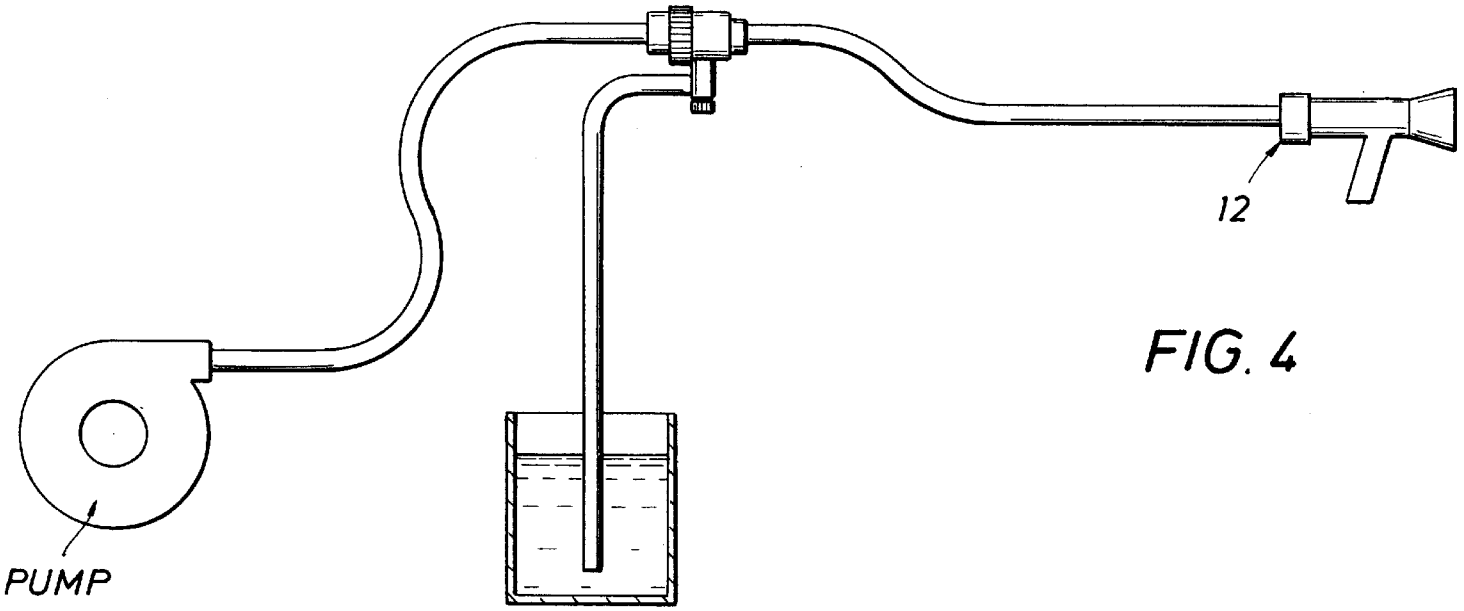
FIG. 4 shows an illustrative view of a typical fire fighting handline operation in two modes of operation: foam (non-by-pass) and water only (by-pass).
Figure 3:
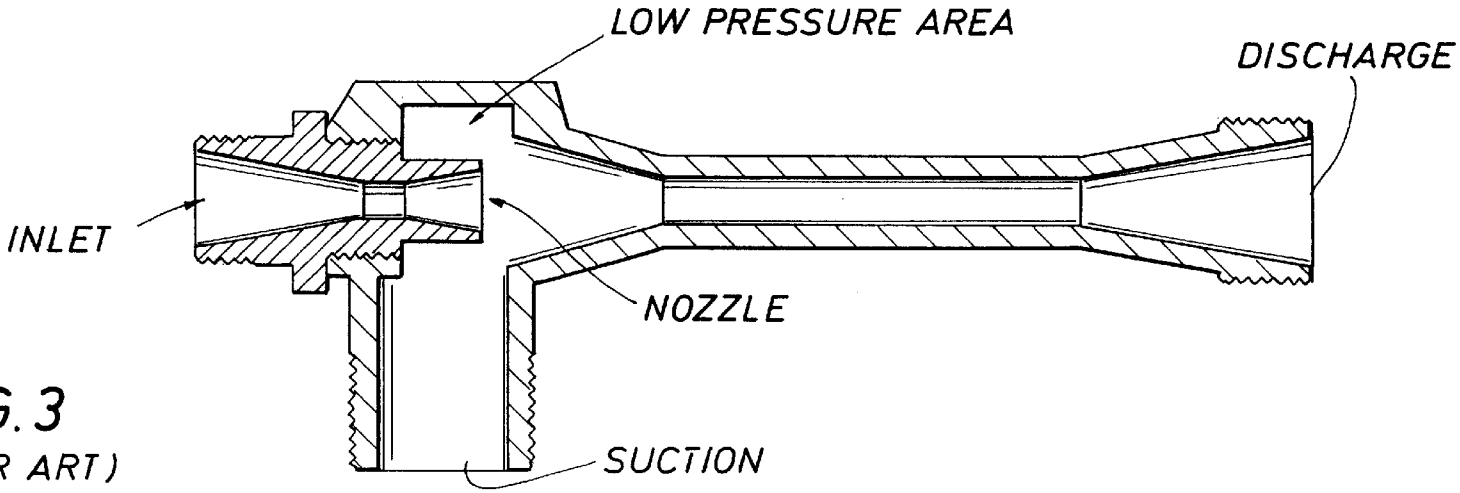
FIG. 3 (PRIOR ART)
FIG. 3 further illustrates a non-by-pass eductor nozzle of the prior art.

In fire fighting operations, nozzles are designed to work with 100 PSI at the nozzle inlet (FIG. 4: 6). Therefore, a nozzle device rated for 125 GPM should flow this at 100

PSI. Stated differently, this nozzle would have a "K Factor" of 12.5. Flow is then determined at any pressure simply by multiplying the K-Factor by the square root of the pressure (flow=K×Sq. Root of P). The proposed invention can be used to support a variety of nozzles, but typically consist of 3 sizes: 60 GPM, 95 GPM, and 125 GPM. A 125 GPM Model will be illustrated for the sake of discussion.

Considering FIG. 4, with 125 GPM flowing in the (non-by-pass) eduction mode, the required pump pressure may be determined as in the following example:

| | |
|---|---|
| 100 PSI | at nozzle inlet (6) |
| 20 PSI | 50' of 1½" fire hose |
| 80 PSI | drop across proposed invention |
| 20 PSI | 50' of 1½: fire hose |
| 220 PSI | required at pump |

The following example would be for the same arrangement in by-pass (water only) operations.

| | |
|---|---|
| 100 PSI | at nozzle inlet (6) |
| 20 PSI | 50' of 1½" fire hose |
| 5 PSI | friction loss in proposed invention - not enough for eduction |
| 20 PSI | 50' of 1½" fire hose |
| 145 PSI | required at pump |

The above examples illustrate the value of being able to change from foam operation to water only mode (non-by-pass to by-pass). The water pump can operate at 145 PSI rather than 220 PSI when foam operations are complete.

Figure 5:
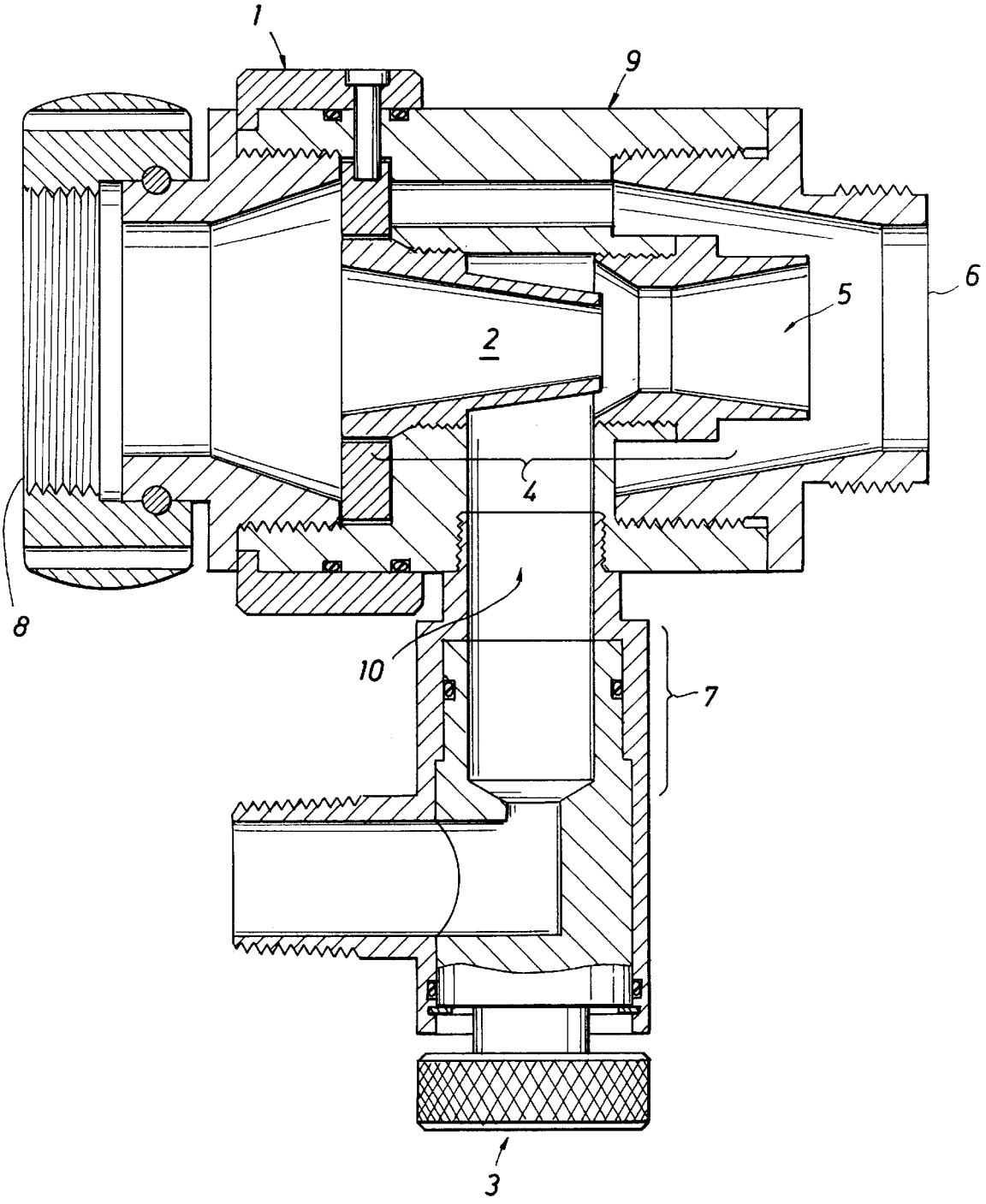
FIG. 5 illustrates in cutaway the proposed invention in connection with a metering valve assembly.

The physics of the eduction (non-by-pass) process can be better understood by referring to FIG. 5. Fluid enters the barrel housing (9) of the eductor assembly under pressure through the inlet port (8). When the rotatable collar of the by-pass control (1) is closed, the water is forced through the venturi jet (2). The jet acts according to Bernouli's Principle in that as velocity is increased, pressure decreases. Therefore, the water exiting the jet has high velocity (kinetic energy) but negligible absolute pressure (static energy). Therefore, a low pressure zone is created around the venturi jet exit area. Since this pressure zone is below ambient (or 0 gauge pressure) a "vacuum" is created. Once the metering valve (3) is opened, the foam pickup line is evacuated by the partial vacuum created by the venturi jet and foam begins to flow toward the eductor (low pressure zone: 4).

Foam enters the metering valve that acts as a throttling device. By rotating the metering valve control knob (3) this flow can be increased or decreased or completely shut off. Where thixotropic foam concentrates are used, this flow passage can be adjusted to be greater (i.e. admit the passage of a greater volume per unit time) than is typically found in Newtonian or non-thixotropic applications.

After passing through the metering valve, the foam passed through an additive port (10) and enters the low pressure zone (4) where it mixes with the incoming jet drive water. Here the velocity of the foam is increased while the jet water velocity is decreased, slightly. At the recovery tube (5) and eductor outlet port (6) the solution (foam & water) velocity is decreased under Bernouli's Principle, thereby increasing pressure. As noted earlier, this loss is typically 40% to 50% of the jet inlet drive water pressure.

Figure 1A:
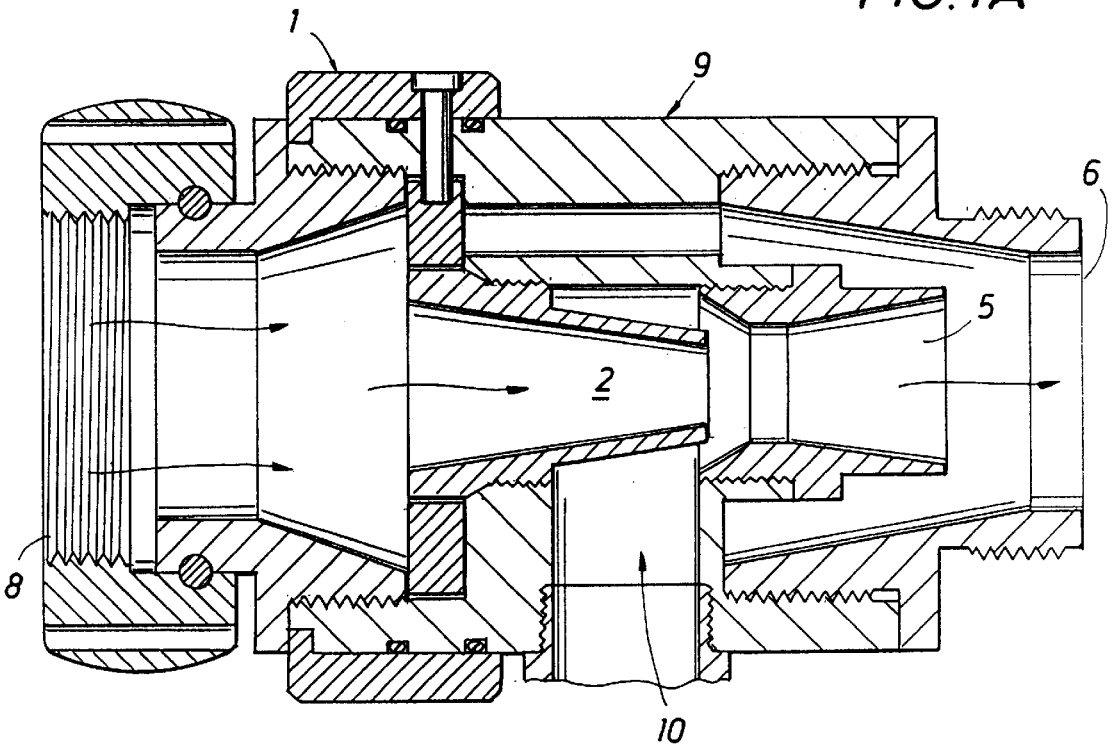
FIGS. 1A and 1B illustrate in cross section an embodiment of the present invention in an eduction mode and a by-pass mode, respectively.
Figure 1B:
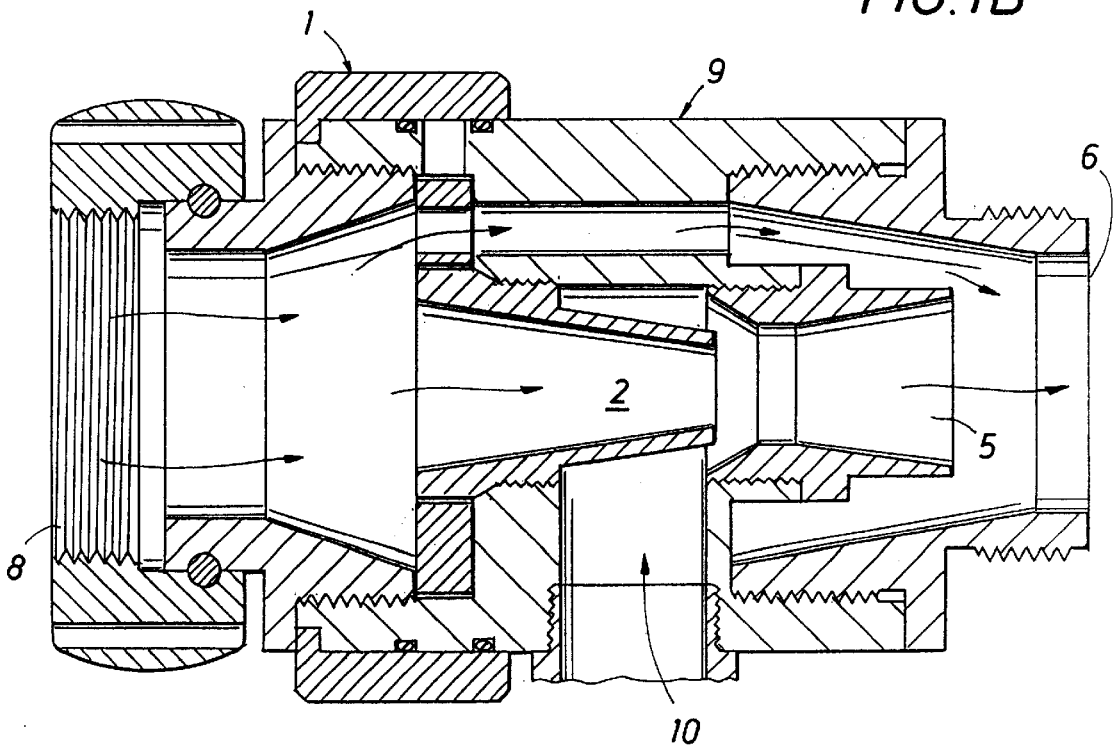

FIG. 1B shows the proposed invention in the water only (by-pass) mode. The rotatable collar of the by-pass control plate is rotated to the open position. This means that a plurality of fluid channels or blow ports open around the jet. Since not all the flow is force through the jet, velocity increase is negligible and hence no low pressure zone is created. The water now tries to flow to the metering valve but the water pressure forces the ball check valve (FIG. 5: 7) to close and no fluid is allowed to exit. This protects an expensive foam source from water contamination.

What is claimed is:

1. An improved additive eductor assembly for fire fighting mechanisms comprising:

a fluid eduction passageway having a venturi in fluid communication with an additive fluid; and a plurality of valvable bypass fluid passageways positioned around the eduction passageway, said bypass and eduction passageways being dimensioned in combination to reduce pressure loss from flow through the assembly to less than 10 pounds per square inch when the bypass passageways are valved open.

2. The eductor assembly of claim 1 wherein the plurality of passageways are valved using a rotateable collar.

3. The eductor assembly of claim 1 including a metering valve assembly connected to an additive fluid passageway to control the flow of additives to said venturi.

4. The eductor assembly of claim 3 wherein said metering valve assembly includes a positive shut-off.

5. The eductor assembly of claim 3 including a check valve within said metering valve assembly to prevent fluid from said fluid stream from back-flowing through said metering valve and substantially contaminating an additive fluid supply.

6. The eductor assembly of claim 5 wherein said check valve is a ball valve.

7. The eductor assembly of claim 1 wherein said additive fluid includes foam.

8. The eductor assembly of claim 7 wherein said foam includes thixotropic foam.

9. The eductor assembly of claim 1 including means for preventing fluid from back-flowing flowing through said metering means and substantially contaminating an additive fluid supply.

* * * * *